US006738054B1

(12) United States Patent
Yamaguchi

(10) Patent No.: US 6,738,054 B1
(45) Date of Patent: May 18, 2004

(54) METHOD AND APPARATUS FOR IMAGE DISPLAY

(75) Inventor: Akira Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/500,225

(22) Filed: Feb. 8, 2000

(30) Foreign Application Priority Data

Feb. 8, 1999 (JP) ..... 11-030008

(51) Int. Cl.[7] ..... G09G 5/00
(52) U.S. Cl. ..... 345/204; 345/205
(58) Field of Search ..... 345/204, 1.3, 205, 345/428, 593; 351/211; 382/162, 276; 347/240

(56) References Cited

U.S. PATENT DOCUMENTS 5,051,929 A * 9/1991 Tutt et al. ..... 345/428
5,225,904 A * 7/1993 Golin et al. ..... 375/240.12
5,390,293 A * 2/1995 Nishioka et al. ..... 345/593
5,846,406 A * 12/1998 Sudhakar et al. ..... 208/216 R
5,848,198 A * 12/1998 Penn ..... 382/276
5,945,972 A * 8/1999 Okumura et al. ..... 345/98
6,040,826 A * 3/2000 Furukawa ..... 345/534
6,141,092 A * 10/2000 Kim ..... 351/211
6,151,410 A * 11/2000 Kuwata et al. ..... 382/162
6,211,967 B1 * 4/2001 Namizuka ..... 347/240
6,243,059 B1 * 6/2001 Greene et al. ..... 345/1.3
6,452,578 B1 * 9/2002 Ito et al. ..... 345/94
6,611,246 B1 * 8/2003 Ito et al. ..... 345/94
6,633,418 B1 * 10/2003 Yamazaki ..... 358/506

* cited by examiner

*Primary Examiner*—Amare Mengistu
*Assistant Examiner*—Prabodh M. Dharia
(74) *Attorney, Agent, or Firm*—Sughrue Mion, PLLC

(57) ABSTRACT

There is provided an image display method in which a supplied image data is converted to image data for frame rate control (FRC) display in accordance with a difference in gradation resolution between a display and the image data. If substantially identical image data within a specified region has a proportion equal to or greater than a specified threshold, the image data within the specified region is converted to image data assigned an integral multiple of a number of frames in FRC. The resulting image data is converted to image data for the FRC display. An image display apparatus is also provided which includes an image display device, a detection device, a data processing device and a supply device. High-quality images can be displayed at a lower gradation resolution than supplied image data. No artifacts result from FRC display, and visibility of flicker is suppressed.

16 Claims, 3 Drawing Sheets

METHOD AND APPARATUS FOR IMAGE DISPLAY

BACKGROUND OF THE INVENTION

This invention relates to the technical field of image display devices such as liquid-crystal displays and CRTs (cathode-ray tubes). More particularly, the invention relates to a method capable of displaying high-quality images without artifacts and flicker even if the image data has a higher gradation resolution than the display to be finally produced. The invention also relates to an apparatus for implementing the method.

The diagnostic images taken with medical diagnostic apparatus such as MRI diagnostic apparatus, X-ray diagnostic apparatus and CR (Computed Radiography) diagnostic apparatus such as FCR (Fuji Computed Radiography) are usually recorded on light-transmitting image recording films such as X-ray films and light-sensitive materials in film form and thereafter reproduced as light-transmissive images. The films showing the reproduced diagnostic images are set on a light source device called a light box ("Schaukasten") and illuminated with a backlight so that the images are viewed for diagnostic purposes.

Medical diagnostic apparatus usually have a monitor (display) such as CRT or a liquid-crystal display (LCD), either built-in or connected, for viewing the diagnostic images taken with the apparatus. Diagnosis is performed on the basis of the image output to the monitor or the diagnostic images yet to be output on films are checked, adjusted or otherwise processed on the monitor.

Diagnostic images taken with medical diagnostic apparatus are usually reproduced on films at a gradation resolution of 10 bits. On the other hand, CRTs usually display images at a gradation resolution of 8 bits and LCDs usually display images at a gradation resolution of 6 bits, sometimes at 8 bits if they are of high performance. Driver ICs (integrated circuits) in excess of 8 bits are not currently available for LCDs. Thus, whichever of the monitors in current use display images with image data having a lower gradation resolution than the image data that has been output from medical diagnostic apparatus.

If images are to be displayed at the usual brightness in the range between about 100 cd/m$^2$ and 200 cd/m$^2$, the lower gradation resolution of 8 bits does not cause any serious problem. However, if the brightness of image display increases, the brightness resolution by human eyes (their ability to distinguish between dark and light areas) also increases and the forced reduction in gradation resolution often causes problematic artifacts in contour lines which are commonly called pseudo-contours.

The medical diagnostic images contemplated by the invention are monochromatic and depend on the difference in image density for diagnosis. To achieve correct diagnosis, it is required that subtle differences in density be identified even in high-density areas with densities in excess of 2. To meet this requirement, the light box emits very bright light, for example, at a brightness of 3,000 cd/m$^2$ or more in accordance with the JIS (the Japanese Industrial Standards) and a correspondingly bright image has to be displayed on the monitor for the medical diagnostic apparatus. In addition, images of very high quality are required in the medical field since an error in the viewing of diagnostic images results in wrong diagnosis. Hence, the artifacts resulting from the forced reduction in gradation resolution can be a serious problem to monitors for medical diagnostic apparatus.

Frame rate control (hereunder referred to as FRC) display is known as a device of solving the problem with image display at reduced gradation resolutions. In this technique, 10-bit image data may be divided by four to give four frames of 8-bit image data which are displayed consecutively to represent a 10-bit gradation in 8 bits. However, this approach suffers from the problem of flicker in the image for the very reason that FRC is performed.

In order to eliminate flicker, the frame frequency in FRC display has to be increased to permit high enough display switching. In practice, however, the driver IC for the monitor and the monitor itself are limited in response speed. This problem presents considerable difficulty in medical applications where an increased number of pixels are used with a view to providing higher image quality by representation of a high-definition image such as QSXGA (2560×2048 pixels).

SUMMARY OF THE INVENTION

The present invention has been accomplished under these circumstances and has as an object providing a method which, when displaying an image at a lower gradation resolution than the image data supplied from its source, performs frame rate control (FRC) display to eliminate artifacts and secure a gradation resolution and a brightness resolution that are substantially equal to those of the supplied image data and which method is capable of displaying a high-quality image that is suppressed in visible flicker without any substantial increase in the frame frequency.

Another object of the invention is to provide an apparatus that operates on the method.

The first object of the invention can be attained by a method for displaying an image based on image data supplied from an image data supply source and having a higher gradation resolution than a display, comprising the steps of:

converting the supplied image data to image data for frame rate control display in accordance with a difference in the gradation resolution between the display and the image data;

converting, if substantially identical image data within a specified region has a proportion equal to or greater than a specified threshold, the image data within the specified region to image data assigned an integral multiple of a number of frames in frame rate control; and thereafter converting the resulting image data to image data for the frame rate control display.

The second object of the invention can be attained by an apparatus for displaying an image based on image data supplied from an image data supply source and having a higher gradation resolution than a display, comprising:

an image display device;

a detection device for detecting a proportion of substantially identical image data within a specified region of the image data;

a data processing device operating based on results of detection by the detection device which, if the proportion is less than a specified threshold, converts the image data within the region to image data for frame rate control display in accordance with a difference in the gradation resolution between the display and the image data and which, if the proportion is equal to or greater than the specified threshold, converts the image data to image data assigned an integral multiple of a number of frames in frame rate control and thereafter converts the resulting image data to image data for the frame rate control display; and a supply device which supplies successively the image display device with image data processed by the data processing device.

In a preferred embodiment, 10-bit image data is received from the image data supply source, the received image data is converted to 8-bit image data for the frame rate control display and the 8-bit image data is displayed.

In another preferred embodiment, the display has a maximum brightness of 500 cd/m$^2$–5,000 cd/m$^2$.

In further preferred embodiment, the data processing device receives 10-bit image data from the image data supply source and converts the received image data to 8-bit image data for the frame rate control display, and the image display device displays the 8-bit image data.

In still further embodiment, the image display device displays in a maximum brightness of 500 cd/m$^2$–5,000 cd/m$^2$.

DETAILED DESCRIPTION OF THE INVENTION

On the pages that follow, the image display method and apparatus of the present invention are described in detail with reference to the preferred embodiment shown in the accompanying drawings.

Figure 1:
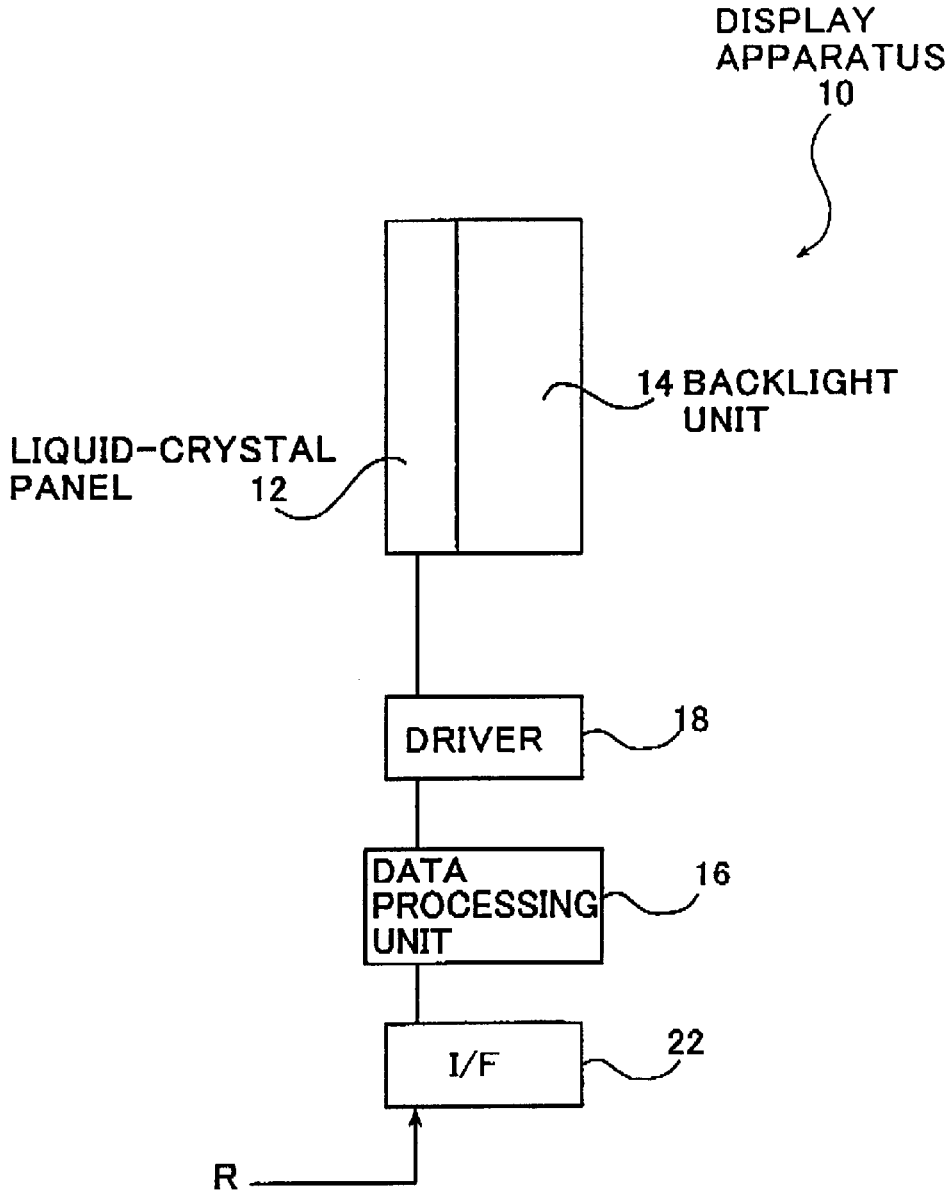
FIG. 1 shows in conceptual form an embodiment of the invention in which the claimed image display apparatus is used as a monitor for a medical diagnostic apparatus.

FIG. 1 shows in conceptual form an embodiment of the invention in which an image display apparatus operating on the claimed image display method of the invention is used as a monitor for a medical diagnostic apparatus. The display apparatus generally indicated by 10 in FIG. 1 is a liquid-crystal display (hereunder referred to as LCD) and comprises a liquid-crystal panel 12 that displays images by liquid crystal, a backlight unit 14, a data processing unit 16, a driver 18 of the liquid-crystal panel 12, and an interface (hereunder referred to as I/F) 22.

The illustrated display apparatus 10 is connected via I/F 22 to medical diagnostic apparatus (hereunder referred to as a diagnostic apparatus) R such as an MRI diagnostic apparatus, an X-ray diagnostic apparatus and CR diagnostic apparatus such as FCR that are sources of diagnostic images to be displayed and from which image data and so forth are supplied to the display apparatus 10.

In the illustrated case, the diagnostic apparatus R supplies image data having a 10-bit gradation resolution whereas the display apparatus 10 displays images at an 8-bit gradation resolution. The necessary image data processing is done by the data processing unit 16 as will be described below in detail.

The display apparatus of the invention is by no means limited to the illustrated LCD and all known types of display apparatus may be employed, as exemplified by a digital micro-mirror device (DMD) display, an electrochromic display (ECD), an electrophoretic image display (EPID), a CRT, a plasma display (PDP), a vacuum fluorescence display (VFD), a light-emitting diode (LED) display, an electroluminescent (EL) display, a field emission display (FED) and an organic EL display.

In the LCD utilizing the concept of the invention, the liquid-crystal panel 12 is not limited to any particular type and all known liquid-crystal panels that are used in various kinds of LCDs may be employed as long as they have a liquid crystal sandwiched between two spaced transparent supports, which are overlaid with transparent electrodes to produce a sheet assembly having polarizers on both sides.

Hence, the liquid-crystal panel 12 (the display apparatus 10 of the invention) may be a full-color or monochromatic type and can be operated in all known modes including a TN (twisted nematic) mode, a STN (supertwisted nematic) mode, an ECB (electrically controlled birefringence) mode, an IPS (in-plane switching) mode and a MVA (multi-domain vertical alignment) mode. The liquid-crystal panel 12 also has no limitations on the switching device or the matrix.

The backlight unit 14 issues backlight for viewing the image displayed on the liquid-crystal panel 12 and may have the same construction as the backlight mechanism in known LCDs.

It should be noted that the display apparatus of the invention preferably has the ability to provide a display at a maximum brightness of 500 cd/m$^2$–5,000 cd/m$^2$ so that it can advantageously be used as a monitor in medical applications. The backlight unit 14 is preferably designed to meet this need by properly selecting and adjusting various factors such as the type of the light source used and the number of light sources.

The illustrated display apparatus 10 occasionally has the need to increase the viewing angle of LCD and to meet this need, a diffusing plate may be provided on the viewing side of the liquid-crystal panel 12 and a collimating plate on the other side.

In the illustrated display apparatus 10, 10-bit image data supplied from the diagnostic apparatus R is sent to the data processing unit 16 via the I/F 22.

The data processing unit 16 is a site where frame rate control (hereunder referred to as FRC) is performed on the supplied 10-bit image data to produce 8-bit image data suitable for image display by the display apparatus 10, which are then supplied to the driver IS of the liquid-crystal panel 12.

Figure 2:
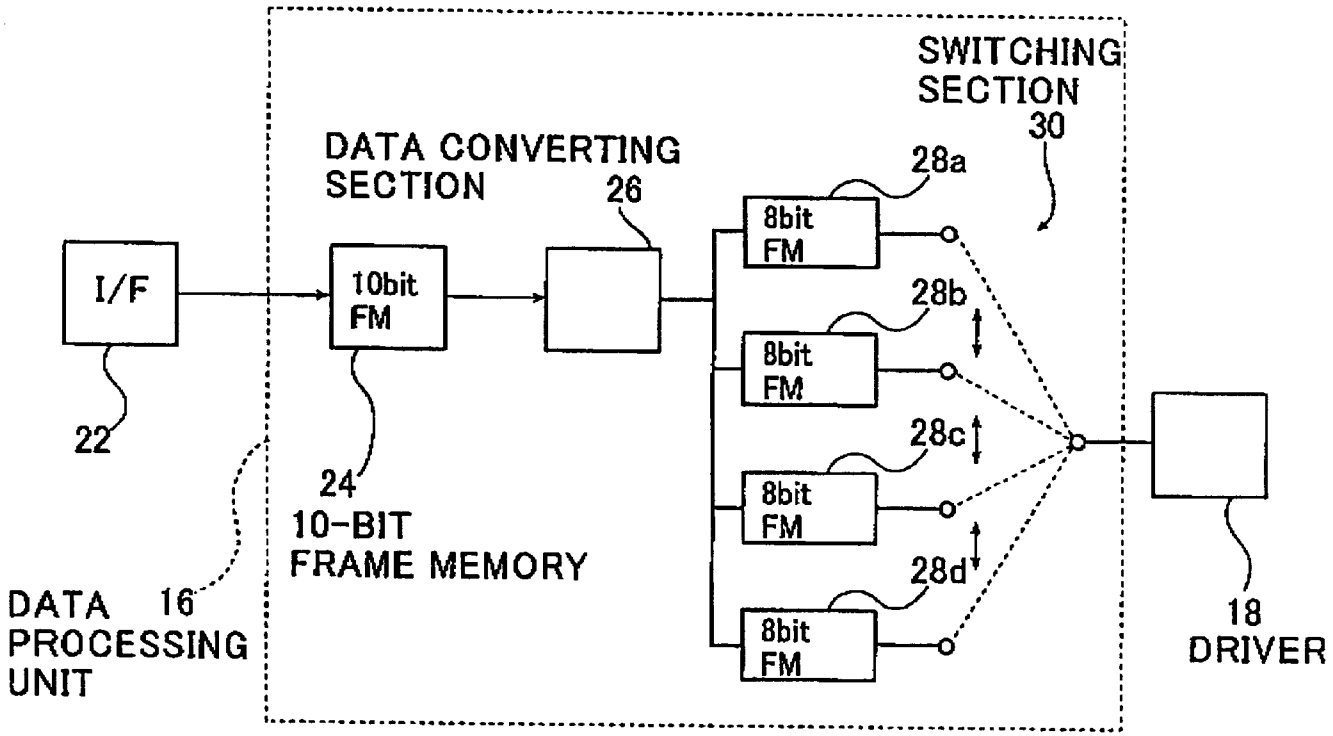
FIG. 2 is a block diagram for an embodiment of the data processing unit of the image display apparatus shown in FIG. 1.

FIG. 2 is a block diagram of the data processing unit 16. In the illustrated case, the data processing unit 16 comprises a 10-bit frame memory (hereunder referred to as FM) 24, a data converting section 26, 8-bit FMs 28*a*, 28*b*, 28*c* and 28*d*, and a switching section 30.

The 10-bit image data supplied from the I/F 22 is stored in FM 24, from which it is read to enter the data converting section 26, where it is converted to 8-bit image data for FRC display.

As is well known, FRC display is a technique for allowing image data of high bit number (gradation resolution) to be displayed with image data of a lower bit number; to this end, the high-bit image data is processed to generate a plurality of frames of lower-bit image data whose number depends on the difference in gradation resolution (number of frames= number of division for FRC), and the generated frames of image data are successively displayed so that the display of a lower-bit image provides a gradation representation equivalent to the high bit number, thereby enabling the display of an image which is very bright and yet does not have any artifacts.

Specifically, $2^n$ frames (where n is the difference in bit number) of lower-bit image data are generated and the generated frames of image data are successively displayed. Take, for example, 8-bit data. Four frames of it are equivalent to 10-bit data. In order to perform FRC display of the 10-bit image data in 8 bits, it is first divided into 4 frames of 8-bit image data which are sequentially displayed to provide a 10-bit gradation representation.

FRC display is an effective way to prevent artifacts but unless the frames in the divided image data are switched rapidly enough, namely, if the frame frequency is not high enough, flicker occurs in the displayed image.

This is not the case with the present invention. In accordance with the proportion of substantially identical image data contained in a specified region, namely, the proportion of a specified area that is occupied by a substantially identical density, the method of computing on the image data to be subjected to FRC display is suitably altered, thereby preventing the occurrence of flickers to enable the representation of a flickerless, high-contrast image without the need to increase the frame frequency.

Figure 3:
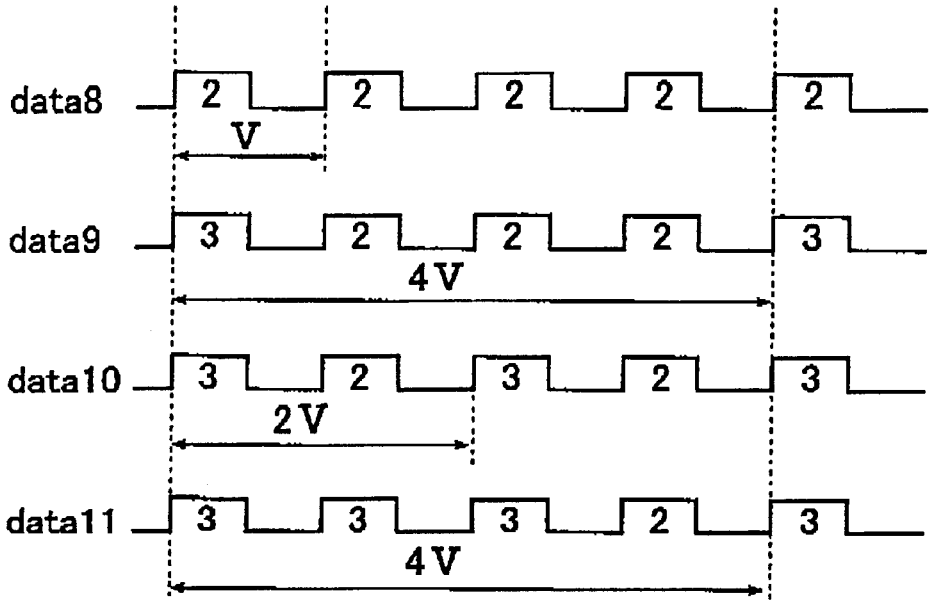
FIG. 3 is an exemplary timing chart for illustrating the claimed image display method of the invention.

As already mentioned, a display of 10-bit image can be represented by 4 frames of 8-bit image in FRC display. According to the timing chart in FIG. 3, 10-bit image data "8" is expressed by 8-bit image data in 4 frames consisting of 2, 2, 2 and 2. Similarly, 10-bit image data "9" is expressed by image data consisting of 3, 2, 2 and 2; 10-bit image data "10" by image data consisting of 3, 2, 3 and 2; image data "11" by image data consisting of 3, 3, 3 and 2.

In the display of black-and-white image (monochromatic image) having a comparatively high brightness as exemplified by medical diagnostic images, visible flicker occurs if the discernible period (temporal repeating unit) is less than 60 Hz. Suppose here that FIG. 3 refers to a still image having a frame frequency V of 60 Hz. With image data "8", the discernible period is 60 Hz for 1V and no visible flicker occurs. With image data "9", the discernible period is 15 Hz for 4V; with image data "10", the discernible period is 30 Hz for 2V; with image data "11", the discernible period is 15 Hz for 4V. In each of these cases, flicker is visible.

According to the study of the inventors, flicker is easy to recognize in a region of constant QL value, or a region of a measurable area having constant image data (to produce a so-called "solid image"), but in a region where various QL values occur simultaneously in small areas, namely, in the case where various kinds of image data coexist, flickers cancel each other to become no longer visible.

Speaking of medical diagnostic images, the region of an actual image that is necessary for diagnosis contains various density levels in small areas and in this region, no flicker is visible even if the discernible period is less than 60 Hz.

That is the operating theory of the present invention. In the data converting section 26, the proportion of substantially identical image data within a specified region is checked and if it is equal to or greater than a specified threshold, the image is converted to a multiple of the number of frames in FRC (in the illustrated case, 10-bit image data is represented as four frames of 8-bit data) and thereafter converted to image data for FRC display; in other cases, the image data is converted to image data for FRC display in the usual manner.

To state simply, those areas of the image which have a high proportion of substantially identical image data typically result when X-rays passed unimpeded; since these areas have no bearing on diagnosis, they are displayed without being rendered to have a higher contrast. On the other hand, those areas of the image which contain various kinds of image data are related to diagnosis and need be displayed in an increased contrast.

This point is further discussed below with reference to FIG. 4. The image shown in FIG. 4 consist of 15×15=(255) pixels each being marked by dashed lines: the hatched region is an actual image containing various kinds of image data; the other regions compose the background and represent identical image data.

The data converting section 26 reads image data from FM 24, divides the image into 15 regions using masks as indicated by solid lines that each consist of 3×3 pixels, detects the proportion of substantially identical image data within each region and determines if it is equal to or greater than a threshold. If the threshold is the total number of pixels (100% pixels), within the regions indicated by thick lines, all images represent identical image data, and the proportion is greater than the threshold.

If the image data read from FM 24 is for the regions (masks) where the proportion occupied by substantially identical image data is less than the threshold, the data converting section 26 generates image data of lower gradation resolution by performing FRC display in the usual manner.

In the illustrated case, 10-bit image data is converted to 8-bit data for FRC display. If the 10-bit image data supplied from the diagnostic apparatus R (I/F 22) is "511", it is converted to 8-bit image data in 4 frames consisting of 128, 128, 128 and 127. Therefore, in the important region containing a flickerless actual image, the appropriate image data enables the representation of the correct image.

If the image data read from FM 24 is for the regions bounded by thick lines where the proportion of substantially identical image data (identical in the illustrated case) is equal to or greater than the threshold, the data converting section 26 converts the image data to a multiple of the number of frames in FRC and thereafter converts the resulting image to image data for FRC display.

Suppose again that 10-bit image data "511" has been supplied from the diagnostic apparatus R (I/F 22). The image data is first converted to a multiple of the frame number 4, say, 10-bit image data "512", which is then converted to 8-bit data in four frames consisting of 128, 128, 128 and 128. Similarly, if the supplied 10-bit image data is "258", it is first converted to 10-bit image data "256", which is then converted to 8-bit data in four frames consisting of 64, 64, 64 and 64.

Thus, all frames are rendered to represent identical image data so that there will be no decrease in the discernible period that results from FRC display, thereby preventing the occurrence of flicker.

According to the invention, very bright images can be displayed with a small number of bits than those which compose the supplied image data. There is no need to increase the frame frequency considerably and yet high-contrast and high-quality images can be displayed without visible flicker and artifacts.

The substantially identical image data as used herein refers to image data of an image for FRC display in which high-order bits corresponding to the resolution for actual representation are identical.

Therefore, when the "resolution of image data=display resolution×number of frames", as mentioned above, "the substantially identical image data is identical image data". When the supplied image data cannot be subjected to FRC display in the display apparatus 10 because of its higher resolution, that is, when the "resolution of image data>display resolution×number of frames", the substantially identical image data refers to more widely delimited image data including identical image data.

For example, when 12-bit image data supplied from the diagnostic apparatus R (I/F 22) is processed in the display apparatus 10 to generate 4 frames of 8-bit image data for FRC display as mentioned above, perfect FRC display of the supplied image data cannot be achieved (the frequency of flicker becomes too low).

In this case, the display apparatus 10 displays a 10-bit image. Then, gradation representation cannot be performed for low-order two bits of the 12-bit image data supplied from the diagnostic apparatus R.

Therefore, if the image data has, in addition to the portions of which the gradation representation is not possible, identical high-order bits, the bits corresponding to the resolution that can provide an actual representation (gradation representation) on the image for FRC display, it can be regarded as identical image data, hence substantially identical image data. In the above case of displaying the 12-bit image data in 10-bit form, the 12-bit image data including identical high-order 10 bits is substantially identical image data.

In other words, if the integer portion of a solution obtained by dividing by the number "$2^m$" corresponding to the difference "m" in the number of bits between the supplied image data and the image data for FRC display (in the embodiment under consideration, $2^m$ is 4, because the difference is 2 bits) is identical in image data, the latter is substantially identical image data.

To this end, the data converting section 26 accordingly detects the proportion of substantially identical image data. As mentioned above, if the proportion of substantially identical image data within a specified region is equal to or greater than a threshold, the image data within the specified region is converted to a multiple of the number of frames in FRC and thereafter converted to image data for FRC display.

Figure 4:
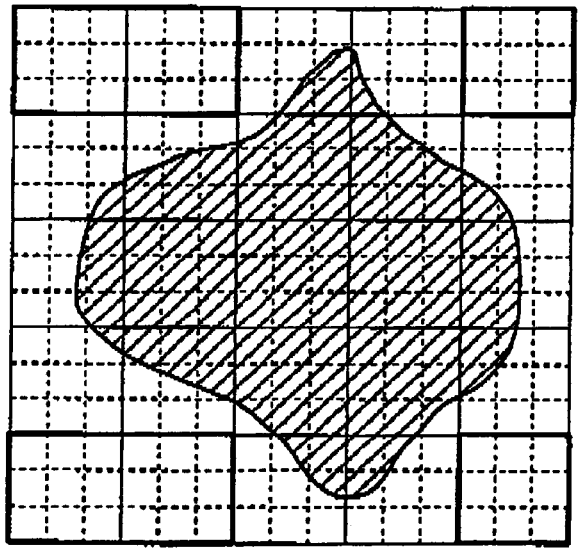
FIG. 4 shows in conceptual form an example of the claimed image display method of the invention.

In the present invention, the area of the specified region for detecting the proportion of substantially identical image data, which is the mask size in the case shown in FIG. 4, is not limited in any particular way and may be determined as appropriate for the size of a pixel; the larger the size (area) of one pixel, the more preferred to reduce the region (mask size).

The threshold for detecting the proportion of substantially identical image data depending on which the supplied image data is converted to a multiple of frame number is not limited in any particular way, either, and may be determined as appropriate for brightness, frame frequency, pixel size and other factors.

The embodiment of the invention is by no means limited to the case of converting 10-bit image data to 8-bit image data for FRC display and, as mentioned above, 12-bit image data may be converted to 10-bit image data for FRC display, or 8-bit image data may be converted to 6-bit image data for FRC display.

The four frames of 8-bit image data for FRC display that have been produced in the data converting section 26 are successively sent for storage in FMs 28*a*–28*d*, which are connected to the driver 18 by means of the switching section 30 on a specified timing as appropriate for the frame frequency so that the stored image data are successively supplied to the driver 18 on the specified timing.

In accordance with the supplied image data, the driver 18 drives the liquid-crystal panel 12 to display an image. As already mentioned, the displayed image has a gradation (brightness) resolution equivalent to those of the 10-bit image data supplied from the diagnostic apparatus R and it is a high-quality image that is free from visible artifacts and flicker.

While the method and apparatus for image display according to the invention have been described above in detail, it should be noted that the invention is by no means limited to the foregoing embodiment and various improvements and modifications may of course be made without departing from the scope and spirit of the invention.

As described above in detail, the present invention enables the display of high-quality images at a lower gradation resolution than the image data supplied from its source. Even if the brightness of display increases, no artifacts result from FRC display; in addition, the visibility of flicker is suppressed without marked increase in the frame frequency.

What is claimed is:

1. A method for displaying an image based on image data supplied from an image data supply source and having a higher gradation resolution than a display, comprising the steps of:

converting the supplied image data to image data for frame rate control display in accordance with a difference in the gradation resolution between the display and the image data;

converting, if substantially identical image data within a specified region has a proportion equal to or greater than a specified threshold, the image data within the specified region to image data assigned an integral multiple of a number of frames in frame rate control; and thereafter converting the resulting image data to image data for the frame rate control display.

2. The method according to claim 1, wherein 10-bit image data is received from the image data supply source, the received image data is converted to 8-bit image data for the frame rate control display and said 8-bit image data is displayed.

3. The method according to claim 2, wherein the display has a maximum brightness of 500 cd/m$^2$–5,000 cd/m$^2$.

4. An apparatus for displaying an image based on image data supplied from an image data supply source and having a higher gradation resolution than a display, comprising:

an image display device;

a detection device for detecting a proportion of substantially identical image data within a specified region of said image data;

a data processing device operating based on results of detection by said detection device which, if said proportion is less than a specified threshold, converts the image data within said region to image data for frame rate control display in accordance with a difference in the gradation resolution between said display and said image data and which, if said proportion is equal to or greater than the specified threshold, converts said image data to image data assigned an integral multiple of a number of frames in frame control and thereafter converts the resulting image data to image data for the frame rate control display; and a supply device which supplies successively said image display device with image data processed by said data processing device.

5. The apparatus according to claim 4, wherein 10-bit image data is received from the image data supply source, the received image data is converted to 8-bit image data for the frame rate control display and said 8-bit image data is displayed.

6. The apparatus according to claim 4, wherein the display has a maximum brightness of 500 $cd/m^2$–5,000 $cd/m^2$.

7. The apparatus according to claim 4, wherein said data processing device receives 10-bit image data from the image data supply source and converts the received image data to 8-bit image data for the frame rate control display, and said image display device displays said 8-bit image data.

8. The apparatus according to claim 4, wherein said image display device displays in a maximum brightness of 500 $cd/m^2$–5,000 $cd/m^2$.

9. The apparatus of claim 4, wherein said detection device divides an image into a plurality of sections comprising a plurality of pixels and said specified region comprises one of the plurality of sections.

10. The apparatus of claim 4, wherein said substantially identical image data is based on similarity in image density, and frame rate processing of all pixels in the specified region is uniform based on the output of the detection device for said specified region.

11. The method according to claim 1, wherein the specified region comprises an area containing multiple pixels, each of substantially identical gradation.

12. The apparatus according to claim 4, wherein the specified region comprises an area containing multiple pixels, each of substantially identical gradation.

13. The method according to claim 11, wherein substantially identical gradation corresponds to image data wherein higher order bits of the gradation of pixels are the same.

14. The apparatus according to claim 12, wherein substantially identical gradation corresponds to image data wherein higher order bits of the gradation of pixels are the same.

15. The method according to claim 1, wherein the number of frames for frame rate control is $2^m$, where m represents the difference in the gradation resolution between the display and the image data, and wherein the specified region is represented by $N*2^m$ gradation, where N is an integer.

16. The apparatus according to claim 4, wherein the number of frames for frame rate control is $2^m$, where m represents the difference in the gradation resolution between the display and the image data, and wherein the specified region is represented by $N*2^m$ gradation, where N is an integer.

* * * * *